US010066418B2

(12) United States Patent
Zhang et al.

(10) Patent No.: US 10,066,418 B2
(45) Date of Patent: Sep. 4, 2018

(54) CHANGEABLE COMBINED MECHANICAL KEY

(71) Applicant: YANTAI TRI-CIRCLE SCIENCE & TECHNOLOGY CO., LTD., Shandong (CN)

(72) Inventors: Yongzhi Zhang, Shandong (CN); Naizhong Chen, Shandong (CN); Yuan Du, Shandong (CN); Xixiang Ding, Shandong (CN)

(73) Assignee: Yantai Tri-Circle Science & Technology Co., Ltd., Shandong (CN)

( * ) Notice: Subject to any disclaimer, the term of this patent is extended or adjusted under 35 U.S.C. 154(b) by 0 days.

(21) Appl. No.: 15/116,461

(22) PCT Filed: Dec. 3, 2014

(86) PCT No.: PCT/CN2014/092863

§ 371 (c)(1),
(2) Date: Aug. 3, 2016

(87) PCT Pub. No.: WO2015/124013

PCT Pub. Date: Aug. 27, 2015

(65) Prior Publication Data

US 2017/0268255 A1 Sep. 21, 2017

(30) Foreign Application Priority Data

Feb. 19, 2014 (CN) ..... 2014 1 0055233

(51) Int. Cl.
*E05B 19/18* (2006.01)
*E05B 19/04* (2006.01)
*E05B 19/24* (2006.01)

(52) U.S. Cl.
CPC ..... *E05B 19/18* (2013.01); *E05B 19/04* (2013.01); *E05B 19/24* (2013.01)

(58) Field of Classification Search
CPC ..... E05B 19/00; E05B 19/0017; E05B 19/04; E05B 19/18
See application file for complete search history.

(56) References Cited

U.S. PATENT DOCUMENTS 2,428,397 A * 10/1947 Sterner ..... E05B 19/18 70/411
2,430,914 A * 11/1947 Ciani ..... E05B 19/18 70/411

(Continued)

FOREIGN PATENT DOCUMENTS

CN 102155111 A 8/2011
CN 202431058 U 9/2012

(Continued)

OTHER PUBLICATIONS

International Search Report and Written Opinion from PCT Application Serial No. PCT/US2014/092863, dated Mar. 5, 2016, 10 pages.

*Primary Examiner* — Christopher J Boswell
(74) *Attorney, Agent, or Firm* — Kinney & Lange, P.A.

(57) ABSTRACT

The present invention relates to a changeable combined mechanical key, belonging to the technical field of key structures of encryption locks. The changeable combined mechanical key includes a bracket detachably connected to an end of a key handle, and a protective cover detachably connected to the end of the key handle and a key-shaped component. The present invention achieves anti-theft and duplication-preventing purposes for a key, and has unique advantages in many important fields such as safety boxes, important military places, banks, household intelligent anti-theft locks, and any other fields that require secrecy security. Unlike an electronic key that is easy to cause a problem due to an electronic circuit device and software and so on, the present invention, which is irreplaceable and has changed a (Continued)

machining process of a traditional mechanical key, saves energy and reduces consumption, and has a broad application prospect.

5 Claims, 6 Drawing Sheets

(56) References Cited

U.S. PATENT DOCUMENTS

| | | | | |
|---|---|---|---|---|
| 3,243,979 | A * | 4/1966 | Silvern | E05B 19/18 70/398 |
| 4,545,226 | A * | 10/1985 | Urrestarazu-Borda | E05B 19/18 70/398 |
| 5,355,702 | A * | 10/1994 | Escribens | E05B 19/18 70/395 |
| 9,151,077 | B2 * | 10/2015 | Valente | E05B 35/004 |
| 9,470,016 | B2 * | 10/2016 | Liao | E02B 19/0035 |
| 9,523,217 | B2 * | 12/2016 | Clifford | E05B 19/00 |
| 2007/0006621 | A1 * | 1/2007 | Doong | E05B 19/04 70/409 |
| 2013/0291361 | A1 * | 11/2013 | Frumkin | E05B 19/00 29/428 |
| 2015/0361689 | A1 * | 12/2015 | Valente | E05B 19/18 70/409 |

FOREIGN PATENT DOCUMENTS

| | | | |
|---|---|---|---|
| CN | 103758407 | A | 4/2014 |
| DE | 3228918 | A1 | 2/1984 |

* cited by examiner

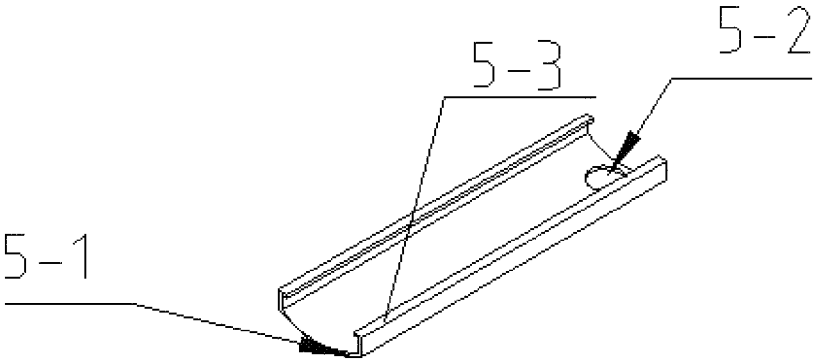
Fig. 6
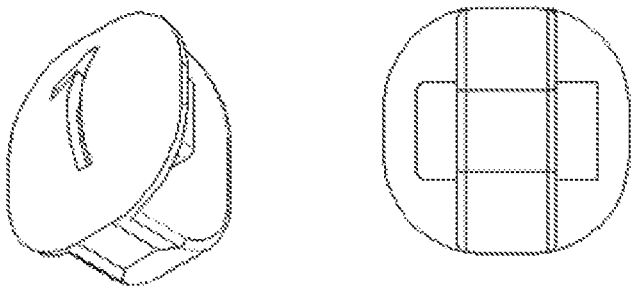
Fig. 7
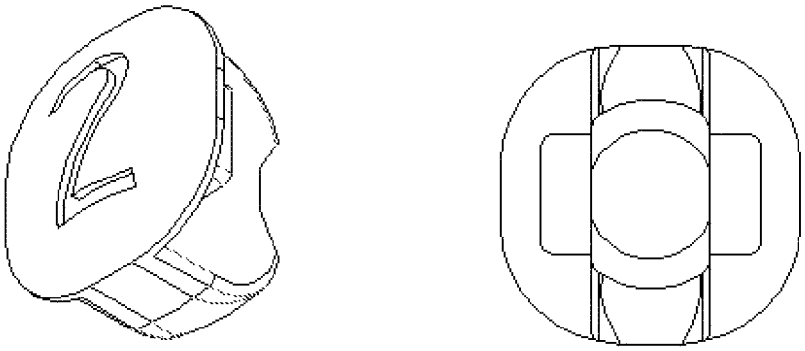

CHANGEABLE COMBINED MECHANICAL KEY

TECHNICAL FIELD OF THE INVENTION

The present invention relates to a changeable combined mechanical key, belonging to the technical field of key structures of encryption locks.

BACKGROUND OF THE INVENTION

At present, higher household security is required with the improvement of people's living standards, and corresponding anti-theft door locks are also advancing towards a goal of higher anti-theft performance constantly. Higher anti-theft performance is required for locks in many other important fields. In recent years, many lock manufacturers have researched and developed products more capable of preventing unauthorized lock opening, such as mechanical anti-theft locks and intelligent electronic anti-theft locks. However, all mechanical anti-theft locks are unlocked by mechanical keys and almost all intelligent electronic anti-theft locks require a backup mechanical key for emergency opening, which brings about a new problem that a theft case is still possible if this mechanical key is stolen or duplicated. The key can be duplicated easily using three-dimensional (3D) scanning with 3D printing in existing scientific and technical conditions regardless how complicated a structure of the key is. Therefore, it is a key to prevent a key from being duplicated to solve potential risk.

SUMMARY OF THE INVENTION

The present invention provides a changeable combined mechanical key for fundamentally achieving anti-theft and duplication-preventing purposes, so as to solve a disadvantage that mechanical keys of various anti-theft locks on the market nowadays are duplicated easily.

The present invention is implemented by the following technical solution.

A changeable combined mechanical key, which changes a traditional integrated structure into a detachable combined structure, is special in that it comprises a bracket 3 detachably connected to an end of a key handle 1, forming a major structure of a key rod and disposed to detachably receive a key-shaped component 4 forming a tooth shape of an unlocking key.

Key-shaped component 4 includes a plurality of independent key-shaped parts, and is installed on the bracket 3, such that the key-shaped parts are arranged and combined to form the key tooth shape capable of being inserted into a core of a lock and capable of being matched therewith to perform unlocking;

A protective cover 5 is detachably connected to the end of the key handle, glidingly sleeved on the periphery of the bracket 3 and matched therewith to locate a framework of the key-shaped component 4 on the bracket 3, and provided with a flat U-shaped structure capable of nesting the bracket 3 therein and a blocking structure for blocking the bracket 3 and the key-shaped component 4, wherein two ends of the flat U-shaped structure are respectively provided with a blocking lug 5-3 locked with the bracket.

The blocking structure on the protective cover 5 refers to a plug 6 integrally punched with the protective cover 5. The plug 6 is provided with an embedded end 6-3 partly embedded into the protective cover 5 and configured to abut and secure the key-shaped component 4, and a connecting end 6-1 connected and fixed with an external end face 5-1 of the protective cover 5; a position of an embedded part of the plug 6 corresponding to the blocking lug 5-3 of the protective cover 5 is provided with a punching hole 6-2 for punching and fixing the plug 6 and the protective cover 5.

The key-shaped component 4 is formed by combining a plurality of key-shaped parts taking height change as level difference; the number of the key-shaped parts depends on the number of corresponding pin tumblers of a locking head for unlocking a lock.

Key-shaped holes 3-1 for accommodating the key-shaped parts respectively are opened on the bracket 3; the key-shaped parts are arranged in the key-shaped holes 3-1 respectively to form the key-shaped component 4.

Upper parts of the key-shaped parts pass through corresponding key-shaped holes 3-1 opened on the bracket 3, and lower parts of the key-shaped parts are provided with contact faces 4-1 capable of contacting a lower end face of the bracket 3 in a position-limiting manner, thereby preventing the key-shaped component from dropping.

A bracket locating hole 3-2 and a protective cover locating hole 5-2 matched and fixedly connected with a bolt hole 1-1 opened on the key handle 1 are provided on the bracket 3 and the protective cover 5 respectively, and the key handle 1, the bracket 3 and the protective cover 5 are finally connected fixedly and integrally through penetration and connection of a bolt 2.

A changeable combined mechanical key of the present invention implements a function of unlocking refusal by changing the location of a combination of key-shaped parts to fundamentally implement anti-theft and anti-duplication purposes of a key, and has unique advantages in many important fields such as safety boxes, important military places, banks, household intelligent anti-theft locks, and any other fields that require secrecy security. Unlike an electronic key that is easy to cause a problem due to an electronic circuit device and software and so on, the present invention, which is irreplaceable and has changed a machining process of a traditional mechanical key, saves energy and reduces consumption, and has a broad application prospect.

BRIEF DESCRIPTION OF THE DRAWINGS

FIG. 6 is a structural diagram of a protective cover in FIG. 1;

FIG. 7 is a structural diagram of a key-shaped part in FIG. 1;

FIG. 8 is a structural diagram of a key-shaped part in FIG. 1;

DETAILED DESCRIPTION OF THE EMBODIMENTS

Specific embodiments of the present invention will be provided below with references to the accompanying drawings to further describe composition of the present invention. Implementation solutions of the present invention comprise, but are not limited to the following embodiments.

Embodiment 1

Figure 1:
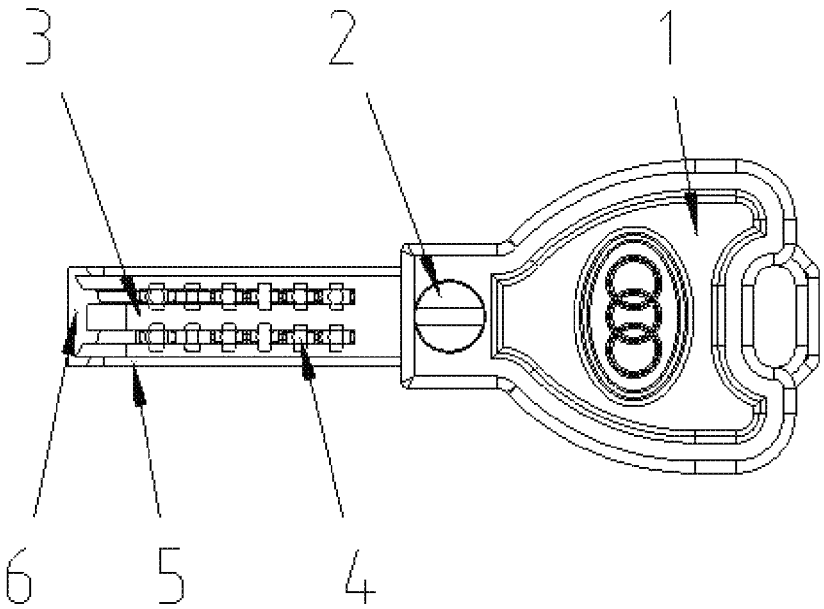
FIG. 1 is a schematic diagram of an assembly structure of a changeable combined mechanical key according to the first embodiment.
Figure 2:
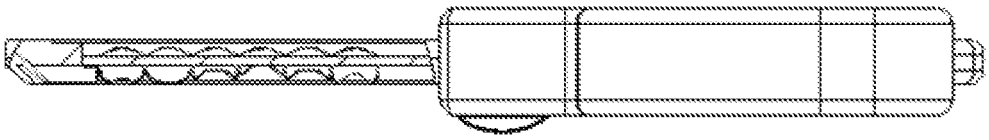
FIG. 2 is a top view of FIG. 1.
Figure 3:
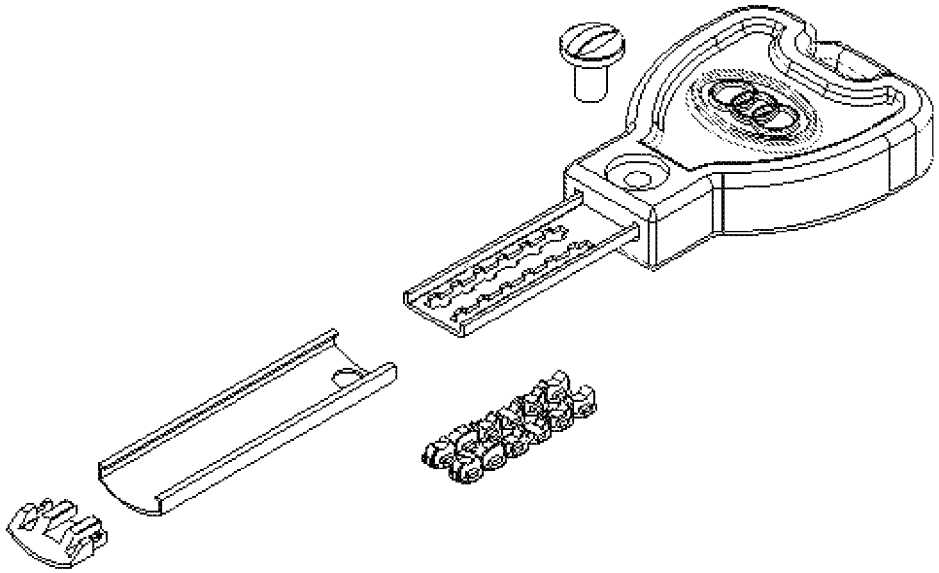
FIG. 3 is an explosive view of FIG. 1.
Figure 4:
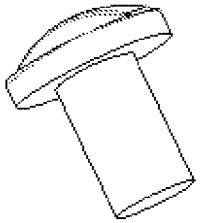
FIG. 4 is a structural diagram of a bolt in FIG. 1.
Figure 5:
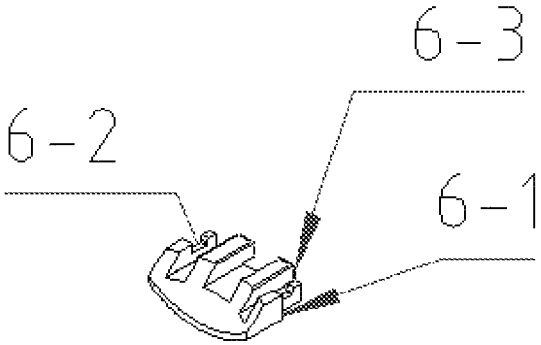
FIG. 5 is a structural diagram of a plug in FIG. 1.
Figure 9:
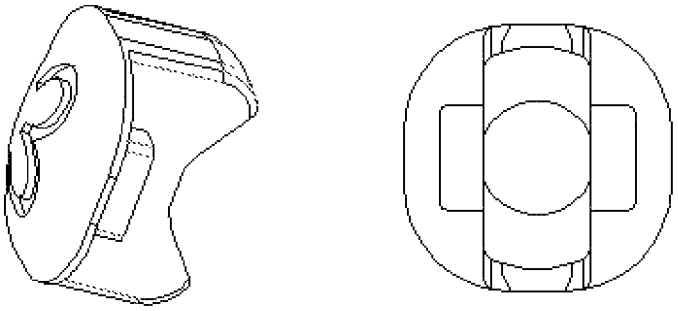
FIG. 9 is a structural diagram of a key-shaped part in FIG. 1.
Figure 10:
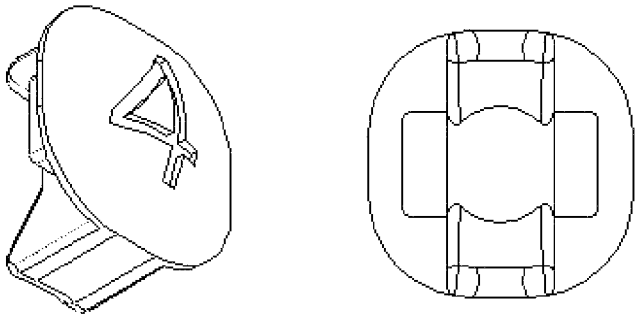
FIG. 10 is a structural diagram of a key-shaped part in FIG. 1.
Figure 11:
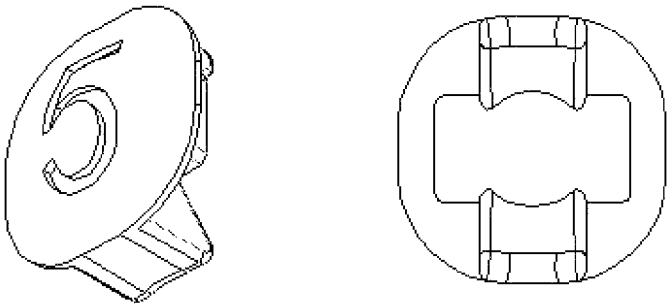
FIG. 11 is a structural diagram of a key-shaped part in FIG. 1.
Figure 12:
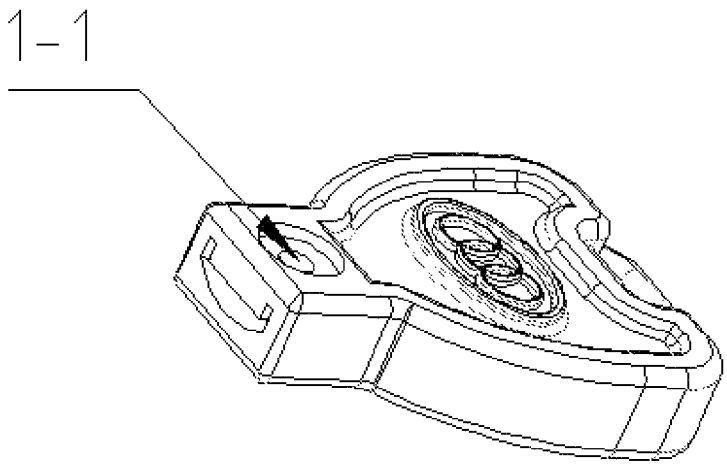
FIG. 12 is a structural diagram of a key handle in FIG. 1.
Figure 13:
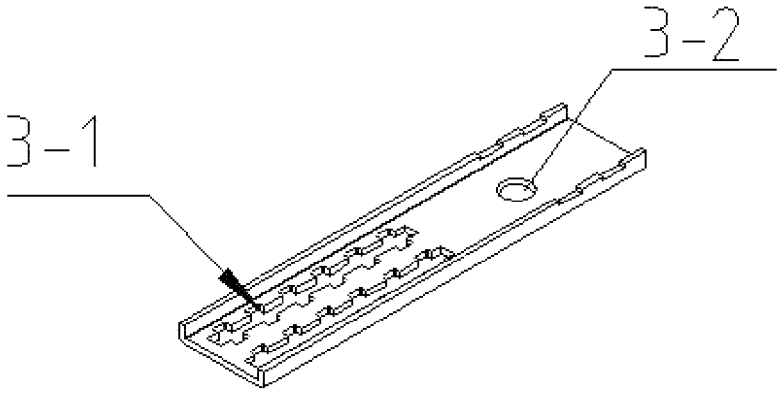
FIG. 13 is a structural diagram of a bracket in FIG. 1.
Figure 14:
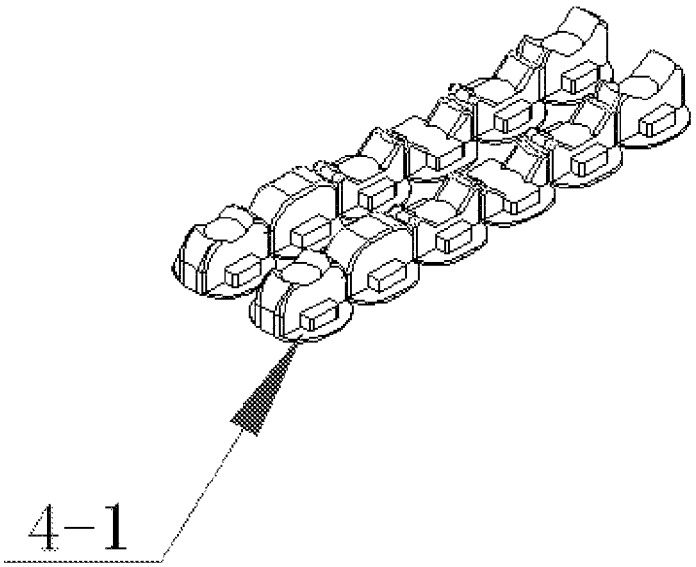
FIG. 14 is a structural diagram of a key-shaped component in FIG. 1.

A changeable combined mechanical key (FIG. 1 to FIG. 14) is developed to solve a disadvantage that mechanical keys of various anti-theft locks on the market nowadays are duplicated easily. The changeable combined mechanical key changes a traditional integrated structure into a detachable combined structure and comprises a bracket 3 detachably connected to an end of a key handle 1, forming a major structure of a key rod and with an upper end face detachably installed with a key-shaped component 4 forming a tooth shape of an unlocking key; the key-shaped component 4 consisting in one embodiment of 12 independent key-shaped parts and installed on the bracket 3, wherein the key-shaped parts are arranged and combined to form the key tooth shape capable of being inserted into a core of a lock and capable of being matched therewith to perform unlocking; a protective cover 5 detachably connected to the end of the key handle 1, configured to assist and to be matched with the bracket 3 to implement a function thereof, provided with a flat U-shaped structure capable of nesting the bracket 3 therein and a blocking structure for blocking the bracket 3 and the key-shaped component 4, wherein two ends of the flat U-shaped structure are respectively provided with a blocking lug 5-3 locked with the bracket. The blocking structure on the protective cover 5 refers to a plug 6 integrally punched with the protective cover 5. The plug 6 is provided with an embedded end 6-3 partly embedded into the protective cover 5 and configured to abut and secure the key-shaped component 4, and a connecting end 6-1 connected and fixed with an external end face 5-1 of the protective cover 5; a position of an embedded part of the plug 6 corresponding to the blocking lug 5-3 of the protective cover 5 is provided with a punching hole 6-2 for punching and fixing the plug 6 and the protective cover 5. The key-shaped component is formed by combining a plurality of key-shaped parts taking height change as level difference. Key-shaped holes 3-1 for accommodating the key-shaped parts respectively are opened on the upper end face of the bracket 3. The key-shaped parts are arranged in the key-shaped holes 3-1 respectively to form the key-shaped component 4. Upper parts of the key-shaped parts pass through the key-shaped holes 3-1 opened on the bracket 3 respectively and lower parts of the key-shaped parts are provided with contact faces 4-1 capable of contacting a lower end face of the bracket 3 in a position-limiting manner, thereby preventing the key-shaped component from dropping. A bracket locating hole 3-2 and a protective cover locating hole 5-2 matched and fixedly connected with a bolt hole 1-1 opened on the key handle 1 are provided on the bracket 3 and the protective cover 5 respectively, and the key handle 1, the bracket 3 and the protective cover 5 are finally connected fixedly and integrally through penetration and connection of an M3 bolt 2.

Compared with a traditional mechanical key, the changeable combined mechanical key of the present invention has several advantages as follows.

1. A fixed integrated mechanical key is changed, so as to change a key shape of the key by changing locations of the key-shaped parts, thereby solving the problem that there is potential risk because the mechanical key is stolen or duplicated.

2. Key components may be machined in one step with a simple machining technique, and produced massively, thereby saving time and labor, saving energy and reducing consumption compared with a traditional key machining technique.

The changeable combined mechanical key of the present invention implements the following principle.

1. The key-shaped parts take height change as level difference.

2. The bolt is dismounted when a code needs to be changed in the case that a locking head is replaced or in order to prevent the key from being duplicated and so on, the protective cover is slid outwards subsequently to expose the key-shaped parts, each of which is provided with a corresponding number as shown in FIGS. 7-11. The locations of the key-shaped parts are changed, and recombined, the protective cover is reset and the bolt is tightened and fixed.

3. During an unlocking process, the bolt is dismounted, the protective cover is moved, and the key-shaped parts are restored to original coding positions to implement unlocking.

The invention claimed is:

1. A changeable combined mechanical key, comprising:

a bracket detachably connected to an end of a key handle, the bracket forming a major structure of a key rod and with an upper end face a key-shaped component detachably installed on the upper end face of the bracket, forming a tooth shape of an unlocking key, and comprising a plurality of independent key-shaped parts, wherein the key-shaped parts are arranged and combined to form the key tooth shape capable of being inserted into a core of a lock and capable of being matched therewith to perform unlocking; and a protective cover detachably connected to the end of the key handle, glidingly sleeved on the periphery of the bracket and matched therewith to locate a framework of the key-shaped component on the bracket, and provided with a flat U-shaped structure capable of nesting the bracket therein and a blocking structure for blocking the bracket and the key-shaped component, wherein two ends of the flat U-shaped structure are respectively provided with a blocking lug locked with the bracket, wherein the blocking structure on the protective cover is a plug integrally punched with the protective cover, wherein the plug is provided with an embedded end partly embedded into the protective cover and configured to abut and fix the key-shaped component, and a connecting end connected and fixed with an external end face of the protective cover, and wherein a position of an embedded part of the plug corresponding to the blocking lug of the protective cover is provided with a punching hole for punching and fixing the plug and the protective cover.

2. The changeable combined mechanical key according to claim 1, wherein the key-shaped component is formed by combining a plurality of key-shaped parts taking height change as level difference; the number of the key-shaped parts depends on the number of corresponding pin tumblers of a locking head for unlocking a lock.

3. The changeable combined mechanical key according to claim 1, wherein:

key-shaped holes corresponding to the key-shaped parts are opened on the upper end face of the bracket; and the key-shaped parts are arranged in the key-shaped holes respectively to form the key-shaped component.

4. The changeable combined mechanical key according to claim 1, wherein upper parts of the key-shaped parts are configured to pass through key-shaped holes opened on the bracket respectively and lower parts of the key-shaped parts are provided with contact faces capable of contacting a lower end face of the bracket in a position-limiting manner.

5. The changeable combined mechanical key according to claim 1, wherein a bracket locating hole and a protective cover locating hole matched and fixedly connected with a bolt hole in the key handle are provided on the bracket and the protective cover, respectively, and the key handle, the bracket and the protective cover are connected fixedly and integrally through penetration and connection of a bolt (2).

* * * * *